US006796632B2

(12) United States Patent
Yamada et al.

(10) Patent No.: US 6,796,632 B2
(45) Date of Patent: Sep. 28, 2004

(54) REFRESH INK EJECTION DEVICE AND INKJET RECORDING DEVICE INCLUDING THE REFRESH INK EJECTION DEVICE

(75) Inventors: Takahiro Yamada, Hitachinaka (JP); Kunio Satou, Hitachinaka (JP); Shinya Kobayashi, Hitachinaka (JP); Hitoshi Kida, Hitachinaka (JP); Kazuo Shimizu, Hitachinaka (JP); Lee Chahn, Hitachi (JP)

(73) Assignee: Hitachi Printing Solutions, Ltd., Kanagawa (JP)

( * ) Notice: Subject to any disclaimer, the term of this patent is extended or adjusted under 35 U.S.C. 154(b) by 0 days.

(21) Appl. No.: 10/363,822

(22) PCT Filed: Apr. 4, 2002

(86) PCT No.: PCT/JP02/03396

§ 371 (c)(1),
(2), (4) Date: Mar. 7, 2003

(87) PCT Pub. No.: WO02/083425

PCT Pub. Date: Oct. 24, 2002

(65) Prior Publication Data

US 2003/0179264 A1 Sep. 25, 2003

(30) Foreign Application Priority Data

Apr. 6, 2001 (JP) ..... 2001-108076

(51) Int. Cl.[7] ..... B41J 2/165; B41J 2/06

(52) U.S. Cl. ..... 347/22; 347/34; 347/36; 347/55

(58) Field of Search ..... 347/35, 75–78

(56) References Cited

U.S. PATENT DOCUMENTS 4,184,167 A * 1/1980 Vandervalk ..... 347/77
4,207,578 A * 6/1980 Marinoff ..... 347/35
4,364,057 A * 12/1982 Ebi et al. ..... 347/81
4,514,735 A * 4/1985 Jones ..... 347/76
6,623,113 B2 * 9/2003 Yamada et al. ..... 347/77

FOREIGN PATENT DOCUMENTS

EP 0755790 A1 1/1997
JP 05162329 * 6/1993 ..... 347/86
JP 11-334106 12/1999
JP 2000-211159 8/2000

* cited by examiner

*Primary Examiner*—Michael S. Brooke
(74) *Attorney, Agent, or Firm*—Whitham, Curtis & Christofferson, P.C.

(57) ABSTRACT

An orifice electrode/ink receiving member 11 is attached to an orifice plate 13 that is attached to a recording head module 10. An ink absorbing member 111 is embedded in a lower surface of the orifice electrode/ink receiving member 11. A recording ink droplet 14 ejected through an orifice 12 is deflected as needed by an angled electric field 85 and then impinges on a recording sheet 60 to form a recording dot 70. On the other hand, a refresh ink droplet 15 is deflected by the angled electric field 85 and impinges on the ink absorbing member 111 of the orifice electrode/ink receiving member 11 after flying in a U-turn path. In this configuration, the ink absorbing member 111 provided to the orifice electrode/ink receiving member 11 collects ink, so that there is no need to increase a gap between the recording head module 10 and the recording sheet 60 so much in order to dispose the ink absorbing member 111, preventing decrease in recording precision and paper jam. Also, it is possible to perform the ink refresh operation using a minimum amount of ink anytime needed without stopping recording operations.

17 Claims, 5 Drawing Sheets

REFRESH INK EJECTION DEVICE AND INKJET RECORDING DEVICE INCLUDING THE REFRESH INK EJECTION DEVICE

This application is a 371 of PCT/JP02/03396 filed Apr. 4, 2002.

TECHNICAL FIELD

The present invention relates to an inkjet recording device, and more particularly to a high-speed inkjet recording device including a refresh ink ejection device capable of performing ink refresh operations without stopping recording operations.

BACKGROUND ART

There have been proposed line-scan inkjet recording devices that print on a continuous recording sheet at high speed. This type of recording device includes a linear recording head that extends across the entire width of the continuous recording sheet. The recording head is formed with nozzles aligned in a row for ejecting ink. Each nozzle includes an ink chamber having an orifice and an energy generating member, such as a piezoelectric element or a heat generating element. When a driving voltage is applied to the energy generating member with the recording head facing the continuous recording sheet, then a pressure is applied to ink inside the ink chamber, whereby an ink droplet is ejected through the orifice. The ejected ink droplet impinges on the continuous recording sheet and thus forms a recording dot thereon. It is possible to control the ink droplet to impinge on a selected location on the continuous recording sheet based on a recording signal. The continuous recording sheet is rapidly transported in its longitudinal direction. By controlling both the sheet feedings and impact positions of ink droplets, recording dots are formed on scanning lines defined on the recording sheet, whereby a desired image is formed.

Various types of line-scan inkjet recording devices have been proposed, such as those using a continuous inkjet recording head and those using a drop-on-demand inkjet recording head. Although the drop-on-demand inkjet recording head has a slower printing speed than the continuous inkjet recording head, the drop-on-demand inkjet recording head has a simple ink system, and so is well suited for general-purpose high-speed recording device.

The present inventors have proposed an ink-droplet deflection type inkjet recording device that includes a charging/deflecting electrode in addition to the drop-on-demand type line-scan inkjet recording head. The charging/deflecting electrode is for deflecting ejected ink droplets so that the ink droplets impinge on desired locations on a recording sheet. The charging/deflecting electrode is disposed in confrontation with orifices to extend along a nozzle row. With this configuration, it is possible to control a plurality of ink droplets ejected from adjacent plural nozzles to impinge on a single pixel location in an overlapping manner. Therefore, even if one or more of nozzles become defective, it is possible to form recording dots using remaining nozzles. That is, the problem of missing information due to defective nozzles can be prevented. Moreover, unevenness in color density of resultant images due to unevenness in nozzle characteristics can be avoided, thereby enhancing reliability in printing operations.

Here, because the drop-on-demand type line-scan inkjet recording head ejects ink droplets in accordance with print data only when needed to form recording dots, some nozzles may not eject ink droplets for a relatively long period of time even during printing operations. If nozzles do not eject ink droplets for a certain time duration, ink clinging around corresponding orifices will dry out, preventing stable ink ejection. In order to overcome this problem, there has been proposed an inkjet recording device including a refresh ink ejection device.

A conventional refresh ink ejection device performs an ink refresh operation by stopping recording operations. Usually, the refresh ink ejection device moves a recording head to a predetermined refreshing position and then control the recording head to eject refresh ink droplets toward an ink receiving member. Japanese Patent Application-Publication No. 2000-211159 discloses a refresh ink ejection device that moves an ink receiving member to a location between a recording head and a recording sheet without moving the recording head. Because there is no need to move the recording head to a refreshing position, an ink refresh operation takes less time duration. A refresh ink ejection device disclosed in Japanese Patent Application-Publication No. HEI-11-334106 performs ink refresh operations without moving a recording head nor an ink collection member. The ink receiving member is disposed between the recording head and a recording sheet at a location away from an ink ejection direction. Ejected refresh ink droplets are deflected toward the ink receiving member by an air current or an electrostatic force and are collected by the ink receiving member without impinging on the recording sheet.

However, no matter which type of the above refresh ink ejection device an inkjet recording device includes, ink refresh operations require to stop printing operations with a resultant reduction in overall printing speed. Also, even when only a small number of refresh ink droplets are required to be ejected for maintaining a good ink ejection performance, excessive refresh ink droplets are inevitably ejected for mechanical reasons, so that ink is wasted more than necessary. Further, it has been difficult to use the conventional refresh ink ejection devices in the above-described high-speed line scan inkjet recording device that prints on a continuous recording sheet using a recording head having a width of the recording sheet for following reasons.

That is, ink ejection frequency greatly differs among nozzles of the recording head having such a head. For example, nozzles located near side edges of the sheet eject inks least frequently. However, even these nozzles need to reliably eject ink in a stable manner when required. Accordingly, it is necessary to perform the ink refresh operations at timings suitable for these nozzles. As a result, the recording operations are disrupted frequently and actual printing speed is greatly decreased.

Further, it is difficult to precisely and quickly stop and restart transporting a continuous recording sheet that is being transported rapidly, and so is difficult to print a high-quality image in succession.

Moreover, in order to dispose the ink receiving member between the recording head and the recording sheet, it is necessary to widen a gap between the recording head and the recording sheet. However, widening the gap between the recording head and the recording sheet degrades printing quality. It is also necessary to provide a sufficient gap between the ink receiving member and the recording sheet. Otherwise, the ink receiving member will be an obstacle to transport the recording sheet, causing paper jam. These problems of recording-quality degradation and paper jam are serious particularly in a device that collects refresh ink droplets by deflecting the same, because in this type of device, it is necessary, for deflecting the refresh ink droplets by a sufficient amount, to widen the gap or to shorten a distance between the ink receiving member and the recording sheet.

In view of forgoing, it is an object of the present invention to overcome the above problems and also to provide a refresh ink ejection device capable of ejecting necessary amount of refresh ink anytime when needed. It is also an object of the present invention to provide an inkjet recording device including a refresh ink ejection device that prevents degradation of printing quality and sheet jam by disposing an ink receiving member without widening a gap between a recording head and a recording sheet.

DISCLOSURE OF THE INVENTION

In order to overcome the above and other objects, a refresh ink ejection device according to the present invention comprises an ink ejection means for generating and ejecting an ink droplet, an ink collector for collecting the ink droplet, and a deflecting means for deflecting the ink droplet ejected from the ink ejection means so that the ink droplet impinges on the ink collector, and is characterized by that the deflecting means includes a conductive member having the same potential as ink that the ink ejection means holds, the conductive member being disposed in vicinity of where the ink droplet is generated, a back electrode disposed behind a recording medium; and a voltage application means for applying a voltage between the conductive member and the back electrode for generating a deflecting electric field, and that the ink droplet ejected from the ink ejection means is deflected by the deflecting electric field and then impinges on the ink collector, and that the ink collector is provided on a surface of the conductive member, the surface facing the recording medium.

With this configuration, the ink droplet ejected by the ink ejection means is deflected by the deflecting electric field generated by the voltage applying means and travels along a u-turn path toward the ink collector. Therefore, the ink droplet is collected by the ink collector without reaching the recording medium. Because the ink collector provided to the surface of the conductive member that is facing the recording medium, there is no need to increase a gap between the ink ejection element and the recording medium by a large amount in order to place the ink collector, preventing degrading recording precision and paper jam.

The deflecting electric field is preferably an angle deflecting electric field having a field element in a direction perpendicular to an ink ejection direction of the ink ejection means. With this configuration, the ink droplet is effectively deflected.

It is preferable that the conductive member have a protrusion protruding toward the back electrode. Alternatively the conductive member could include an orifice plate formed with a nozzle and a conductive plate provided on the orifice plate. With this configuration, the angled deflecting electric field can be easily generated. Also, the conductive member and the ink collector could be formed integrally with each other.

The ink collector could be an ink absorbing member. Alternatively, a narrow groove for leading ink could be formed in a surface of the ink collector. With this configuration, the ink droplet impinged on the ink collector is reliably collected.

The ink residing on the ink collector can be collected by using an ink receiving member that includes a vacuum pump or a large-capacity ink absorbing member connected to the ink collector.

Further, an inkjet recording device according to the present invention comprises an ink ejection means for generating and ejecting an ink droplet, a first control means for controlling the ink ejection means to eject an recording ink droplet, a second control means for controlling the ink ejection means to eject a refresh ink droplet, an ink collector for collecting the refresh ink droplet, and an deflecting means for deflecting the refresh ink droplet so that the refresh ink droplet impinges on the ink collector, and is characterized by that the deflecting means includes a conductive member having the same potential as ink that the ink ejection means holds, the conductive member being disposed in vicinity of where the ink droplet is generated; a back electrode disposed behind a recording medium; and a voltage applying means for applying a voltage between the conductive member and the back electrode so as to generate a deflecting electric field, and that the ink collector is disposed on a surface of the conductive member, the surface facing the recording medium, and that the deflecting electric field deflects the recording ink droplet as needed, wherein the deflected recording ink droplet impinges on the recording medium, and that the deflecting electric field deflects the refresh ink droplet so that the deflected refresh ink droplet impinges on the ink collector.

With this configuration, the recording ink droplet ejected by the first control means impinges on the recording medium and forms a recording dot. On the other hand, the refresh ink droplet ejected by the second control means is deflected by the angled deflecting electric field to flying along a U-turn path toward the ink collector, so that the refresh ink droplet is collected by the ink collector without reaching the recording medium. Because the ink is collected by the ink collector provided to the surface of the conductive member facing the recording medium, there is no need to increase a gap between the ink ejection means and the recording medium by a large amount, preventing degradation in recording precision and paper jam. Further, because the second control means can control to eject a selected number of refresh ink droplets at a selected timing, waste of ink is prevented, and the operation is performed flexibly.

The first control means can control to eject the recording ink droplet based on a recording signal during a recording operation, and the second deflecting means can control to eject the refresh ink droplet during a time interval where no recording ink droplet is ejected during the recording operation, without stopping the recording operation. Because there is no need to stop the recording operation for ejecting the refresh ink droplet, it is possible to avoid decrease in throughput. Further, because there is no need to stop and then restart transporting the recording medium, it is possible to form high-quality images continuously, so that the present invention is well adopted to a high-speed line-scanning inkjet recording device that forms images on a uncut-elongated recording medium.

It is preferable that the second control means control the ink ejection means to eject the refresh ink droplet at a lower ejection speed than the recording ink droplet. The refresh ink droplet ejected at a slow ejection speed is more easily deflected by the angled deflecting electric field and thus reliably collected by the ink collector.

It is preferable that the refresh ink droplet have a smaller weight than the recording ink droplet. The refresh ink droplet having a smaller weight is more easily deflected by the angled deflecting electric field and thus reliably collected by the ink collector.

It is preferable to provide a charging means for charging the refresh ink droplet and the recording ink droplet, the charging means charging the refresh ink droplet to a larger potential than the recording ink droplet. The refresh ink droplet charged with a greater potential is more easily deflected by the angled deflecting electric field and thus reliably collected by the ink collector.

The deflecting electric field is preferably an angled deflecting electric field having a field element in a direction perpendicular to an ink ejection direction of the ink ejection means. With this configuration, the ink droplet is effectively deflected.

BEST MODE FOR CARRYING OUT THE INVENTION

Next, inkjet recording devices including refresh ink ejection devices according to embodiments of the present invention will be described with reference to attached drawings.

Figure 1:
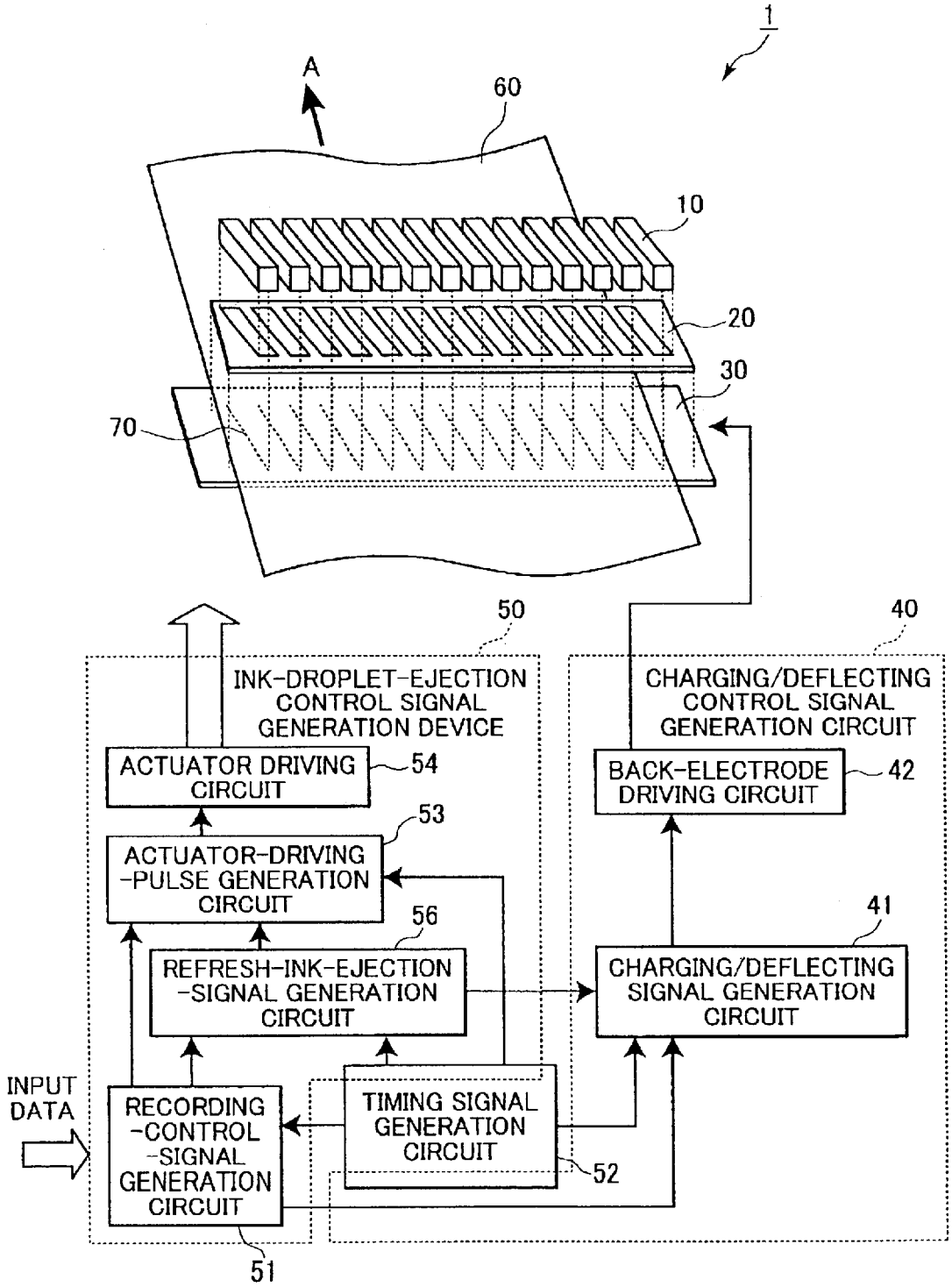
FIG. 1 shows a configuration of an inkjet recording device including a refresh ink ejection device according to a first embodiment of the present invention.

FIG. 1 shows an inkjet recording device 1 including a refresh ink ejection device according to an embodiment of the present invention. The inkjet recording device 1 is an ink-droplet deflection drop-on-demand line-scan recording device. As shown in FIG. 1, the inkjet recording device 1 includes a recording head module mounter 20, a back electrode 30, a charging/deflecting control signal generation circuit 40, and an ink-droplet-ejection control signal generation device 50. The recording head module mounter 20 mounts a plurality of recording head modules 10. The back electrode 30 is disposed at the rear of a recording sheet 60 so as to confront the recording head module mounter 20 via a sheet transport path. The charging/deflecting control signal generation circuit 40 is for supplying charging/deflecting signal to the back electrode 30. The ink-droplet-ejection control signal generation device 50 is for controlling ejection of ink droplets based on input data from an external device.

The charging/deflecting control signal generation circuit 40 includes a charging/deflecting signal generation circuit 41 and a back-electrode driving circuit 42. The ink-droplet-ejection control signal generation device 50 includes a recording-control-signal generation circuit 51, a timing signal generation circuit 52, an actuator-driving-pulse generating circuit 53, an actuator driving circuit 54, and a refresh-ink-ejection-signal generation circuit 56.

The timing signal generation circuit 52 generates a timing signal, and outputs the timing signal to the recording-control-signal generation circuit 51, the actuator-driving-pulse generating circuit 53, the refresh-ink-ejection-signal generation circuit 56, and the charging/deflecting signal generation circuit 41.

The recording-control-signal generation circuit 51 generates recording control signals based on the input data and the timing signal, and outputs the same to the actuator-driving-pulse generating circuit 53, the refresh-ink-ejection-signal generation circuit 56, and the charging/deflecting signal generation circuit 41. The refresh-ink-ejection-signal generation circuit 56 generates a refresh-ink-ejection actuator driving signal based on the recording control signal, and outputs the same to the actuator-driving-pulse generating circuit 53 and the charging/deflecting signal generation circuit 41. The actuator-driving-pulse generating circuit 53 generates a recording pulse signal based on the recording control signal and also generates a refresh-ink-ejection pulse signal based on the refresh ink-ejection-actuator driving signal. The recording pulse signal and the refresh-ink-ejection pulse signal are both ink droplet ejection control signal for driving an actuator 55 (FIG. 3) of the recording head module 10 to be described later. The actuator driving circuit 54 amplifies the recording pulse signal and the refresh-ink ejection pulse signal to an appropriate level for driving the actuator 55.

Figure 5:
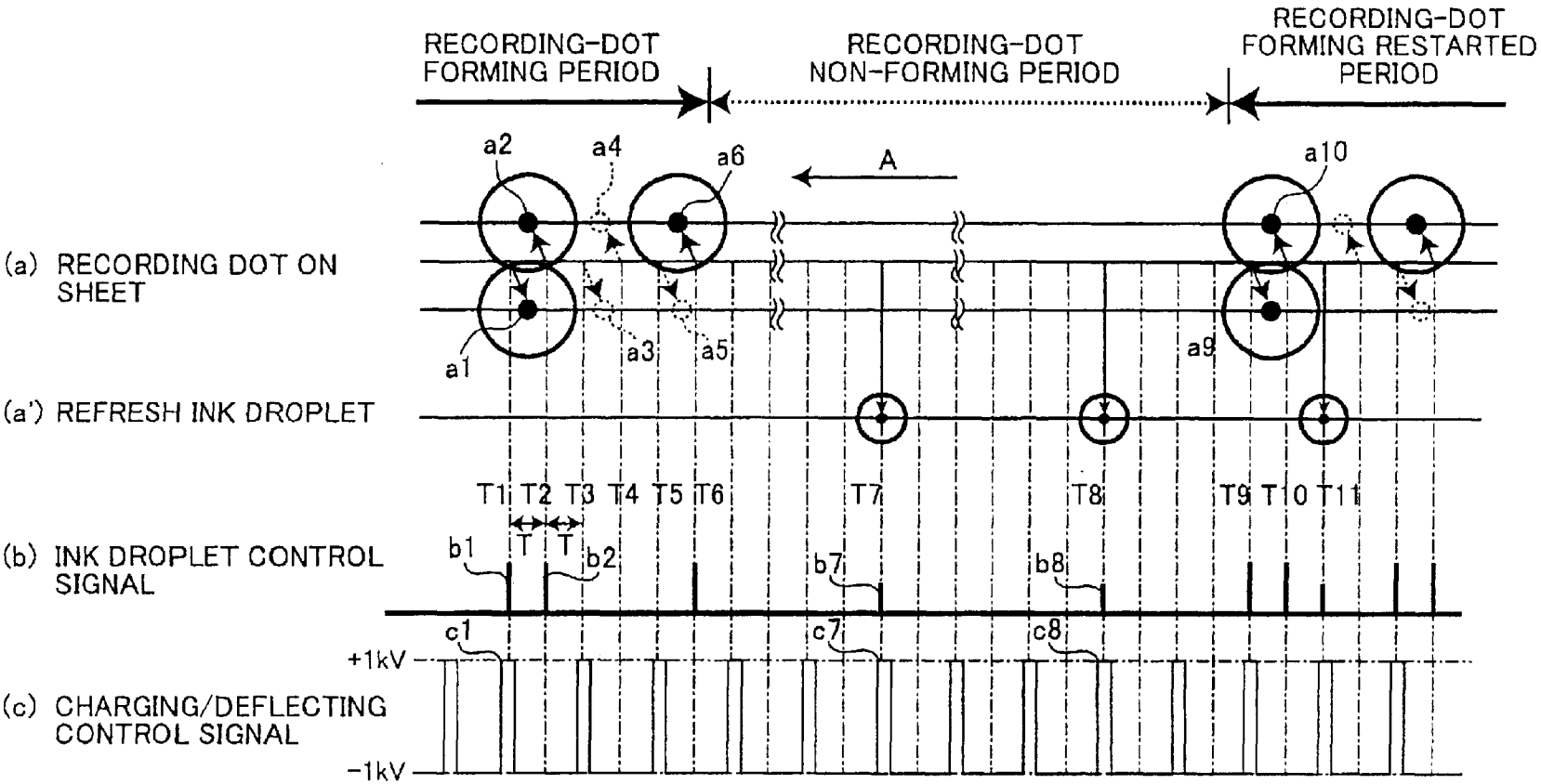
FIG. 5 is an explanatory view showing recording operations and ink refresh operations performed by the inkjet recording device of FIG. 1.

The charging/deflecting signal generation circuit 41 generates a predetermined charging/deflecting signal (voltage) based on the timing signal from the timing signal generation circuit 52 and on the recording control signal from the recording-control-signal generation circuit 51 or on the refresh-ink-ejection actuator driving signal from the refresh-ink-ejection-signal generation circuit 56, and output the same to the back-electrode driving circuit 42. The back-electrode driving circuit 42 amplifies the charging/deflecting signal to a predetermined voltage, and then outputs the same to the back electrode 30. As shown in FIG. 5(*c*), the charging/deflecting voltage from the back-electrode driving circuit 42 periodically changes between +1 KV and −1 KV.

Figure 2:
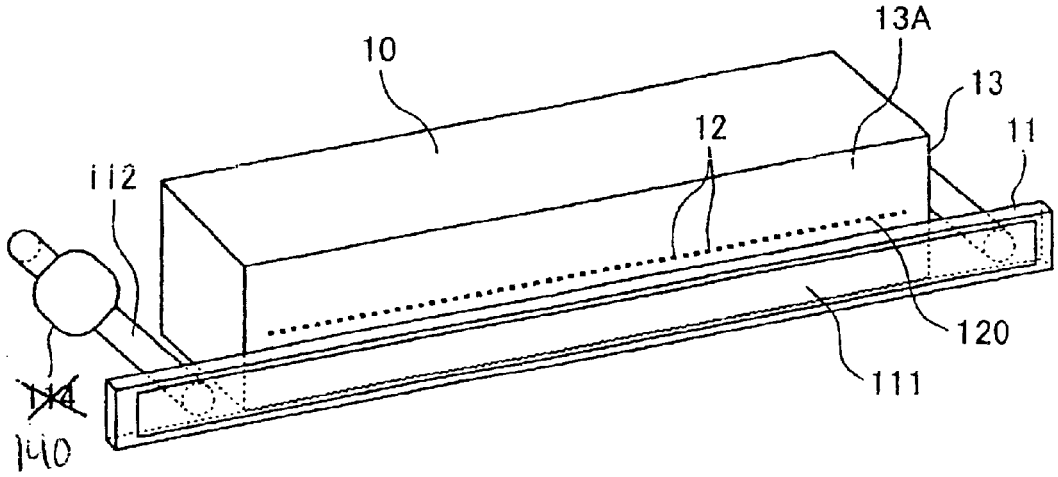
FIG. 2 is an enlarged perspective view of a recording head module of the inkjet recording device of FIG. 1.

Next, configuration of the recording head module 10 will be described. The recording head module 10 is an on-demand linear inkjet recording head module. As shown in FIG. 2, each recording head module 10 has an orifice plate 13 made of conductive material, such as metal. The orifice plate 13 is formed with an orifice row 120 including n-number of orifices 12 aligned equidistance from one another. Each orifice 12 has a diameter of about 30 $\mu$m. The orifice plate 13 has an orifice surface 13A, on which an orifice electrode/ink receiving member 11 is provided. The orifice electrode/ink receiving member 11 serves as an electrode for generating an angled electric field and as an ink collector for receiving refresh ink droplets.

Here, the orifice plate 13, the orifice electrode/ink receiving member 11, the back electrode 30 together provide the refresh ink ejection device of the present embodiment.

Figure 3:
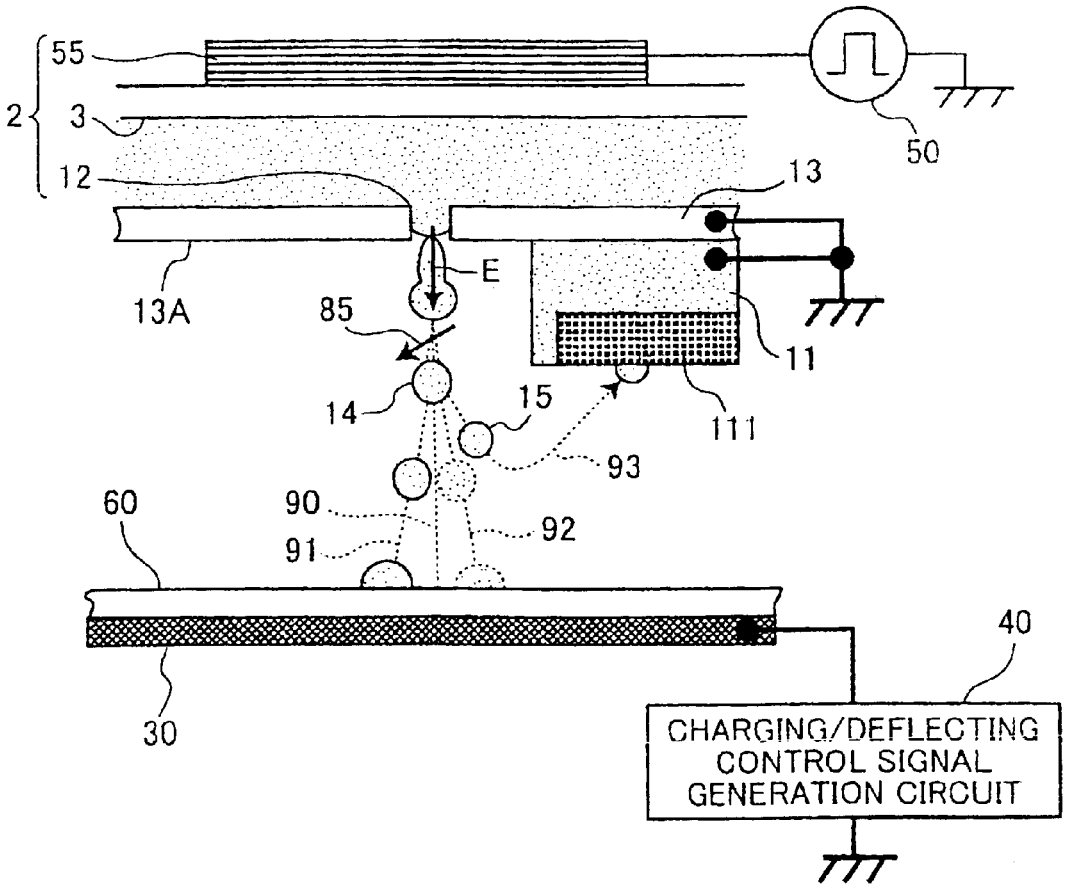
FIG. 3 shows an arrangement of a charging electrode of the inkjet recording device of FIG. 1.

The recording head module 10 will be further described. As shown in FIG. 3, the recording head module 10 has n-number of nozzle elements 2 (only one nozzle element 2 is shown in FIG. 3). The nozzle elements 2 have the same configuration, and each has the orifice 12 formed in the orifice plate 13, a pressure chamber 3, and the actuator 55, such as a piezoelectric element. The pressure chamber 3 has the orifice 12 as its opening end, and houses ink therein. The actuator 55 is attached to the pressure chamber 3. The ink-droplet-ejection control signal from the ink-droplet-ejection control signal generation device 50 is input to the actuator 55. Although not shown in the drawings, each recording head module 10 is further formed with ink inlet ports for introducing ink to the pressure chambers 3 and a manifold for supplying ink to the ink inlet ports.

When the ink-droplet-ejection control signal from the ink-droplet-ejection control signal generation device 50 is applied to the actuator 55, then the actuator 55 changes the volume of the pressure chamber 3, thereby ejecting an ink droplet through the orifice 12. In the present embodiment, when the ink-droplet-ejection control signal from the ink-droplet-ejection control signal generation device 50 is the recording pulse signal, then a recording ink droplet 14 with a mass of about long is ejected to an ejection direction E, that is, a direction perpendicular to the recording sheet 60, at a velocity of 5 m/s. On the other hand, when the ink-droplet-ejection control signal is the refresh-ink-ejection pulse signal, then a refresh ink droplet 15 with a mass of about 7 ng is ejected in the ejection direction E at a velocity of 2.5 m/s. Thus ejected ink droplets 14, 15 will fly straight along an undeflected ink droplet flying path 90 and impinge on the recording sheet 60 if not deflected. However, in the present embodiment, the ink droplets 14, 15 are deflected. Details will be described later.

The orifice electrode/ink receiving member 11 shown in FIG. 2 is an electrically conductive plate made of metal or the like to a thickness of about 0.5 mm, for example, and is disposed near where ink droplets to be ejected from the nozzle elements 2 are generated. In the present embodiment, the orifice electrode/ink receiving member 11 is attached on the orifice surface 13A of the orifice plate 13 about 300 $\mu$m away from the orifice row 120 to extend along the orifice row 120. The orifice electrode/ink receiving member 11, the orifice plate 13, and the ink inside the nozzle elements 2 are all grounded.

As shown in FIGS. 2 and 3, the orifice electrode/ink receiving member 11 has a lower surface (surface that faces to the recording sheet) 1, in which an ink absorbing member 111 having a thickness of about 0.2 mm is embedded. The ink absorbing member 111 could be a plate made of stainless steel fibers or a porous stainless steel of sintered compact. As shown in FIG. 2, the ink absorbing member ill is connected to an ink absorbing pipe 112 and a vacuum pump 140 provided to the sides of the recording head module 10. Ink in the ink absorbing member 111 spreads due to capillary action, and is discharged through the ink absorbing pipe 112 due to a negative pressure generated by vacuum pump 140.

As shown in FIGS. 1 and 3, the back electrode 30 is a flat plate formed of conductive material, such as metal, and is disposed parallel to the orifice surface 13A at a position about 1.5 mm distanced from the orifice surface 13A. Because the charging/deflecting control voltage from the charging/deflecting control signal generation circuit 40 is applied to the back electrode 30, the back electrode 30 has a potential corresponding to the charging/deflecting control voltage. Because the charging/deflecting control voltage of the present embodiment changes between +1 KV and −1 KV as mentioned above, the voltage of the back electrode 30 also changes between +1 KV and −1 KV.

Figure 4:
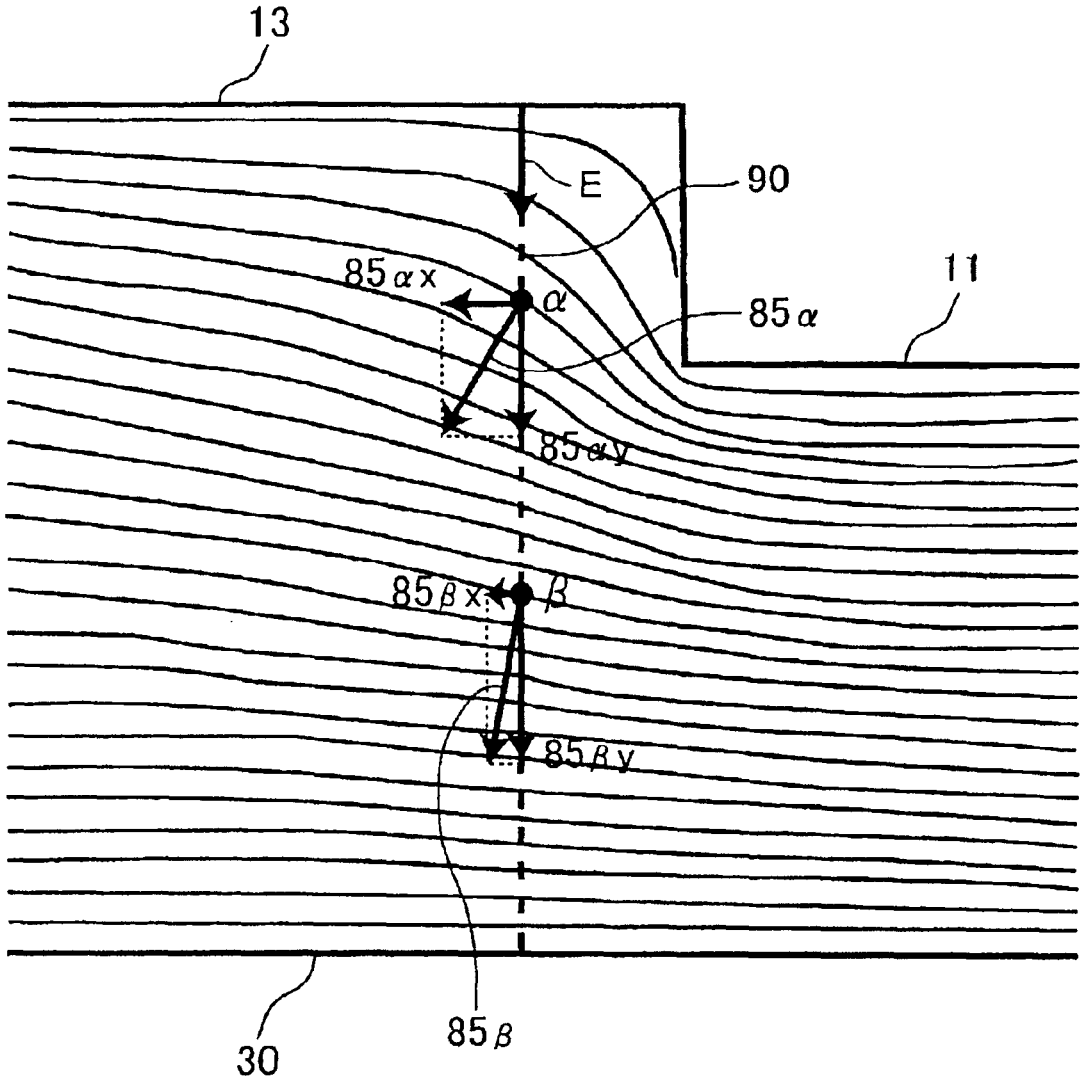
FIG. 4 shows an equipotential surface of an angled deflection electric field generated by the deflection electrode arrangement of FIG. 3.

As described above, the orifice electrode/ink receiving member 11 and the orifice plate 13 are grounded. Therefore, when the charging/deflecting control voltage of −1 KV is applied to the back electrode 30, then an electric field is generated among the orifice electrode/ink receiving member 11 and the orifice plate 13 and the back electrode 30. FIG. 4 shows an equipotential surface 80 of the electric field. As will be understood from FIG. 4, the direction of the electric field is angled with respect to the ejection direction E near the undeflected ink droplet flying path 90, thereby generating the angled electric field 85. For example, an angled electric field 85$\alpha$ generated at a location $\alpha$ has a field element 85$\alpha x$ in a direction perpendicular to the undeflected ink droplet flying path 90 and a field element 85$\beta y$ in a direction parallel to the ejection direction E.

Therefore, in FIG. 3, the ink droplets 14, 15 ejected through the orifice 12 are charged because of the charging/deflecting control signal generated in the charging/deflecting control signal generation circuit 40, and then deflected to a direction perpendicular to the undeflected ink droplet flying path 90, i.e., in a direction perpendicular to the ejection direction E, by the angled electric field 85. That is, in FIG. 4, the ink droplets are deflected by the field component 85 $\alpha x$ of the angled electric field 85 at the location $\alpha$.

More specifically, an ink droplet ejected through the orifice 12 is positively or negatively charged with a predetermined charging amount depending on the potential of the back electrode 30 at the time of the ejection, and then deflected by the angled electric field 85. A positively charged recording ink droplet 14 is deflected leftward in FIG. 3 by the angled electric field 85, and flies along a flight path 91. On the other hand, a negatively charged recording ink droplet 14 is deflected rightward in FIG. 3 by the angled electric field 85, and flies along a flight path 92. Therefore, by controlling ejection and nonejection of a recording ink droplet 14 and by controlling a deflection direction of a recording ink droplet 14, it is possible to form a desired image with recording dots 70 (FIG. 1) on the recording sheet 60.

Here, as will be understood from FIG. 4, the component 85 $\alpha$ of the angled electric field 85 in the location $\alpha$ that is an early flight stage of a recording ink droplet 14 is more angled with respect to the undeflected ink droplet flying path 90 than the component 85 $\beta$ in a location $\beta$ that is later flight stage. This indicates that the field component 85 $\alpha x$ deflects an ink droplet more than do the component 85 $\beta x$. Therefore, it is possible to greatly deflect the recording ink droplet 14 in its early flight stage, and also to further deflect the recording ink droplet 14 while the recording ink droplet 14 keeps flying. In this manner, it is possible to effectively deflect the charged recording ink droplet 14. Here, when the charged recording ink droplet 14 is deflected by the angled electric field 85, the recording ink droplet 14 receives an influence of field components 85 $\alpha y$ and 85 $\beta y$ also. This accelerates or decelerates the recording ink droplet 14 in the ink droplet ejection direction E depending on its polarity.

On the other hand, the refresh ink droplet 15 is set to be negatively charged, and as shown in FIG. 3, reaches the ink absorbing member 111 after flying along a U-turned flight path 93. This is because that the refresh ink droplet 15 is lighter in weight and ejected in lower ejection speed than the recording ink droplet 14, and that the refresh ink droplet 15 is easily deflected by the angled electric field 85.

Next, an operation of the inkjet recording device 1 will be described while referring to a specific example. In a recording operation in this example, recording ink droplets 14 ejected from a single orifice 12 are deflected. In this recording operation, while feeding a recording sheet 60, as shown in FIG. 5, a recording-dot forming period for forming recording dots on the recording sheet 60 and a recording-dot non-forming period for forming no recording dots are alternatively repeated. Here, the recording-dot non-forming period includes, for example, periods between letters, between ruled lines, and between graphics where no recording dots are formed. The recording-dot non-forming period also includes a recording sheet transporting period between pages where no recording dots are formed. In the present embodiment, a recording-dot forming period following a recording-dot non-forming period is referred to as a recording-dot re-forming period.

FIG. 5(*a*) shows recording dots formed on the recording sheet 60, and FIG. 5(*a'*) shows refresh ink droplets 15. FIG. 5(*b*) shows the ink droplet ejection control signals (recording pulse signals and refresh-ink-ejection pulse signals) from the ink-droplet-ejection control signal generation device 50. FIG. 5(*c*) shows the charging/deflecting control signal generated in the charging/deflecting control signal generation circuit 40. It should be noted that the recording sheet 60 is transported in a direction indicated by an arrow A in FIG. 1 at a constant speed by a transporting mechanism (not shown).

First, in a first recording-dot forming period, a recording pulse b1 is applied to the actuator 55 at a time T1 shown in FIG. 5(*b*). As a result, a recording ink droplet 14 is ejected through an orifice 12 slightly after the time T1. At this time, a charging/deflection control voltage c1 of +1 KV is being applied to the back electrode 30, so that the recording ink droplet 14 ejected in response to the pulse b1 is negatively charged, and flies toward the recording sheet 60. During the flight, as shown in FIG. 5(*c*), the charging/deflection control voltage is switched to −1 KV, whereby the angled electric field 85 is generated. The charged recording ink droplet 14 is deflected by the angled electric field 85, flies along the flight path 92 shown in FIG. 3, and form a recording dot on the recording sheet 60 at a dot position a1 (FIG. 5(*a*)). Here, the recording ink droplet 14 is decelerated during its flight.

When a time period T elapses, as shown in FIG. 5(*b*), a pulse b2 is applied to the actuator 55 at a time T2. As a result, a recording ink droplet 14 is ejected slightly after the time T2. At this time, a charging/deflection control voltage of −1 KV (FIG. 5(*c*)) is being applied to the back electrode 30, so that the recording ink droplet 14 ejected in response to the pulse b2 is positively charged. Because the charging/deflection control voltage is maintained of −1 KV while the positively charged recording ink droplet 14 is flying, the recording ink droplet 14 is deflected by the angled electric field 85 and flies along the flight path 91 shown in FIG. 3. Eventually, the recording ink droplet 14 impinges on the recording sheet 60, and forms a recording dot on a dot location a2 (FIG. 5(*a*)). In this case, the recording ink droplet 14 is accelerated during the flight.

When a next time duration T elapses, no pulse signal is applied to the actuator 55 at a time T3 (FIG. 5(*b*)), so that no ink droplet is ejected. Accordingly, no recording dot is formed on a dot location a3 shown in FIG. 5(*a*). When next and subsequent time durations T elapse, no ink droplet is ejected at time T4 or T5, so that no recording dot is formed on dot locations a4 and a5.

At time T6, in the same manner as when the recording dot is formed on the dot location a2 (FIG. 5(*a*)), an recording ink droplet 14 ejected in response to a recoding pulse b6 is positively charged because of the charging/deflecting control signal of −1 KV. The recording ink droplet 14 is deflected by the angled electric field 85 and forms a recording dot on a dot location a6. After repeatedly performing the above operations, a desired image is obtained on the recording sheet 60 as shown in FIG. 5(*a*).

After the above operations in the recording-dot forming period are completed, a recording-dot non-forming period starts. In this period, no ink droplet 14 is ejected though the orifice 12. Therefore, there is a danger that ink clinging around the orifice 12 dries and gets dense, and that thus condensed ink prevents stable ejection of the recording ink droplet 14 at the early stage of a subsequent recording-dot formation period, preventing precise recording.

In order to overcome the above problems, in the present embodiment, refresh ink droplets 15 are ejected at predetermined timing during the recording-dot non-forming period. That is, as shown in FIG. 5(*b*), refresh-ink-ejection pulse signals b7 and b8 are applied to the actuator 55 at time T7 and T8, respectively. Because the width of the refresh-ink-ejection pulse signals b7 and b8 is set smaller than that of the recording pulses b1 and b2, it is possible to eject light refresh ink droplets 15 at a reduced ejection speed compared with the recording ink droplets 14. These refresh ink droplets 15 are negatively charged by the charging/deflecting control signals c7 and c8 of +1 KV, respectively, and start flying toward the recording sheet 60. However, because the refresh ink droplets 15 are light and ejected at the reduced speed, the refresh ink droplets 15 are decelerated by the angled electric field 85 and forced back toward the orifice plate 13. At the same time, the refresh ink droplets 15 are deflected in a direction perpendicular to the ejection direction E by the angled electric field 85. As a result, the refresh ink droplets 15 fly along the U-turned flight path 93 shown in FIG. 3 as described above, and reaches the ink absorbing member 111 of the orifice electrode/ink receiving member 11.

It should be noted that if the voltage of the charging/deflecting control signals c7, c8 for the refresh ink droplets 15 is set greater than that of the charging/deflecting control signal c1 and the like for the recording ink droplets 14, the refresh ink droplets 15 is charged to a greater charging amount. This facilitates deflecting the refresh ink droplet 15 in U-turn. Accordingly, the refresh ink droplet 15 is further reliably collected while reliably preventing the refresh ink droplet 15 from impinging on the recording sheet 60.

When the above recording-dot non-forming period ends, the recording-dot re-forming period starts. Recording ink droplets 14 are ejected at time T9 and T10, and recording dots are formed on dot locations a9 and a10. Because the above-described ink refresh operations prevent the ink clinging near the orifice 12 from getting dense, the recording ink droplets 14 are properly and stably ejected even at the time T9 and time T10 which are relatively early stage of the recording-dot forming period. Therefore, the recording dots are properly formed on the dot locations a9 and a10.

As described above, according to the refresh ink ejection device, it is possible to individually and precisely control each one of refresh ink droplets 15. Therefore, it is possible to eject a necessary amount of, that is, even one refresh ink droplet 15 at an optimum timing.

Also, because the ink absorbing member 111 is embedded in the orifice electrode/ink receiving member 11, the ink absorbing member 111 does not cause paper jam. Further, it is unnecessary to increase a gap between the recording head module 10 and the recording sheet 60 in order to place the ink absorbing member 111, so that preciseness in recording is prevented from degrading.

In the above embodiment, refresh ink droplets 15 are elected at predetermined timings during the recording-dot non-forming period. However, it is also possible to eject refresh ink droplets 15 during the recording-dot re-forming period also. In this case, the refresh-ink-ejection-signal generation circuit 56 monitors the ejection conditions of recording ink droplets 14 from each orifice 12 based on the recording control signal. Then, if ink-droplet non-ejection condition lasts for a long time period time, then the refresh-ink-ejection actuator driving signal is generated for ejecting a refresh ink droplet 15. For example, in FIG. 5(*b*), if no recording ink droplet 14 is ejected after a predetermined time has elapsed since the recording ink droplet 14 has been ejected at the time T10, then the refresh ink droplet 15 is ejected at time T10, then the refresh ink droplet 15 is ejected at time T11 a predetermined time duration after the time T10. In this manner, the refreshing operation is performed even in the recording-dot forming period by generating the refresh ink droplet 15 during the time interval where the recording ink droplet 14 is not ejected without stopping the recording operation. Accordingly, decrease in throughput can be prevented even if there is an orifice 12 that does not perform ink ejection for a long period time. Also, proper ink ejection operations are maintained because there is no need to delay the refreshing operations until the recording-dot non-forming period. In this case, a timer for measuring a time duration since the ink ejection was last performed could be provided for each nozzle element 2.

According to the present embodiment, even a single refresh ink droplet 15 can be ejected in the refreshing operation, so that it is possible to eject only a minimum amount of ink without ejecting more than necessary amount of ink, preventing wasting ink. Further, the ink refresh operation can be performed only for necessary nozzle element 2. There is no need to perform the ink refresh operation for all of the nozzle elements 2 at the same time. It is possible to perform ink refresh operation at timing and frequency appropriate for each nozzle element 2 in accordance with the ink ejection condition thereof.

Next, a second embodiment of the present invention will be described while referring to FIG. 6. In the present embodiment, the recording head module 10 is attached with an orifice-electrode/ink receiving member 110 shown in FIG. 2. Ink grooves 113 are formed in the lower surface of the ink receiving member 110 to extend in the longitudinal direction of the orifice-electrode/ink receiving member 110 at a pitch of approximately 160 $\mu$m. The ink grooves 113 are narrow grooves for directing ink, and have a width of approximately 80 $\mu$m, and a depth of approximately 80 $\mu$m. The orifice-electrode/ink receiving member 110 is formed with ink outlet ports 114 penetrating through its longitudinal ends. A pair of ink absorbing members 115 formed of sponge material or the like to have a large absorbing capacity are disposed behind the orifice-electrode/ink receiving member 110 to be embedded in the ink outlet ports 114.

In this configuration, the refresh ink droplet 15 reaches the orifice-electrode/ink receiving member 110 after flying along a U-turn path spreads across the ink grooves 113 due to capillary action and then is absorbingly collected into the ink absorbing members 115 through the ink outlet ports 114. In this configuration, the vacuum pump can be dispensed with. Needless to say, it is possible to provide the ink absorbing pipe 112 shown in FIG. 2 connected to the ink outlet ports 114 so as to collect ink using the ink absorbing pipe 112.

Figure 7:
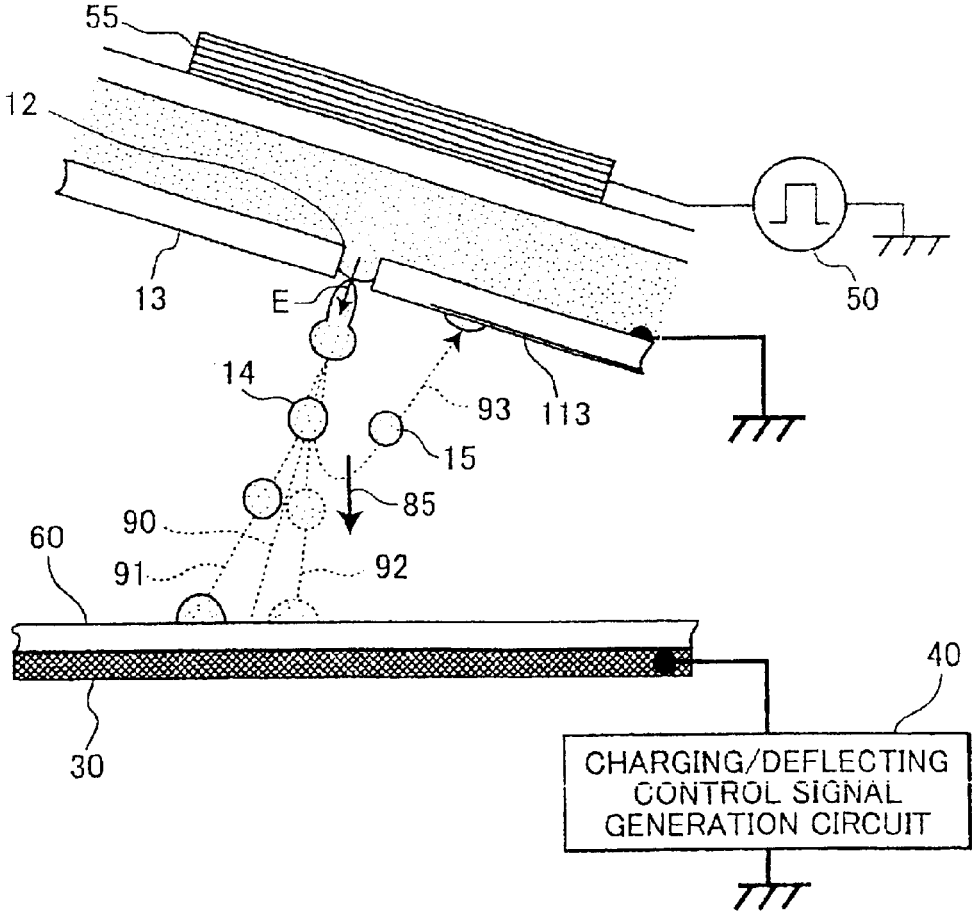
FIG. 7 shows an arrangement of a deflection electrode of an inkjet recording device that includes a refresh ink ejection device according to a third embodiment of the present invention.

Next, a third embodiment will be described with reference to FIG. 7. The present embodiment uses the orifice plate 13 inclined with respect to the back electrode 30 without the orifice electrode/ink receiving member 11. This configuration also can generate the angled electric field 85 having an element perpendicular to the undeflected ink droplet flying path 90 so is capable of deflecting ink droplets. The ink grooves 113 rather than the orifice electrode/ink receiving member 11 is formed in a bottom surface of the orifice plate 13. The refresh ink droplet 15 traveled along a U-turn path reaches the ink grooves 113 and collected therethrough.

In this configuration, it is possible to form the back electrode 30 to have an arc shape, such as a drum shape.

While some exemplary embodiments of this invention have been described in detail, those skilled in the art will recognize that there are many possible modifications and variations which may be made in these exemplary embodiments while yet retaining many of the novel features and advantages of the invention.

Figure 6:
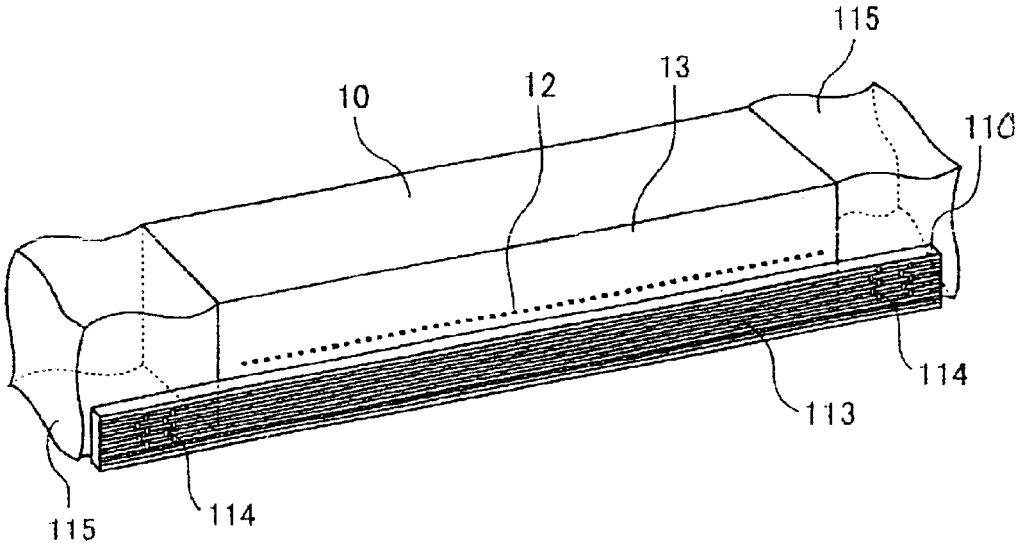
FIG. 6 is an enlarged perspective view showing a portion of a recording head module that includes an refresh ink ejection device according to a second embodiment of the present invention.

For example, it is possible to use the ink absorbing members 115 shown in FIG. 6 rather than the ink absorbing pipe 112 shown in FIG. 2 in the first embodiment.

Also, in any of the above-describe embodiments, it is possible to control a plurality of ink droplets ejected from different nozzles 12 onto the same pixel or vicinity of the same pixel in overlapping manner by setting the nozzle pitch, controlling ink ejection from the nozzles 12, and selecting deflection direction and deflection amount in an appropriate manner, so that even when one or more nozzle element 2 becomes defective, allotted recording dots can be reliably formed using remaining nozzle elements 2. In this manner, a highly reliable inkjet recording device can be provided. Also, because each pixel is recorded using a plurality of nozzle elements 2, unevenness in color density appearing on resultant images can be prevented.

Although the recording ink droplets in the above embodiments are deflected to one of two directions so as to fly along either the flight path 91 or the flight path 92 at both sides of the undeflected ink droplet flying path 90, there is no limitation in the number of the deflecting directions and in the deflecting amount.

Needless to say, the recording ink droplet could be controlled to fly along the flying path 90 without being deflected at all. In this case, only the refresh ink droplets are deflected to fly along the U-turn path.

INDUSTRIAL APPLICABILITY

Refresh ink droplets ejected by ink refresh operations are collected by an ink receiving member provided to the conductive member that generates a deflection electric field. Accordingly, there is no need to increase a gap between an ink ejection means and a recording sheet, so that it is possible to prevent decrease in recording precision and paper jam. Also, because the ink refresh operations are performed without stopping recording operations, stable ink ejection is maintained without sacrificing the throughput.

Further, because a necessary ink element only individually performs the ink refresh operation using only a necessary amount of ink, waste of ink is avoided. Because the same deflecting electric element deflects both the recording ink droplets and the refresh ink droplets, the device can have a simple configuration.

What is claimed is:

1. A refresh ink ejection device comprising an ink ejection means for generating and ejecting a refresh ink droplet, an ink collector for collecting the refresh ink droplet, and a deflecting means for deflecting the refresh ink droplet ejected from the ink ejection means so that the refresh ink droplet impinges on the ink collector wherein the deflecting means includes:

a conductive member including the ink collector provided on a surface of the conductive member, facing the recording medium, said conductive member and said ink collector having the same potential as ink that the ink ejection means holds, the conductive member being disposed in vicinity of where the ink droplet is generated;

a back electrode disposed behind a recording medium; and a voltage application means for applying a voltage between the conductive member including said collector and the back electrode for generating a deflecting electric field;

whereby the ink droplet ejected from the ink ejection means is deflected by the deflecting electric field and then impinges on the ink collector.

2. The refresh ink ejection device according to claim 1, wherein the deflecting electric field is an angled deflecting electric field having a field element with a direction perpendicular to an ink ejection direction of the ink ejection means.

3. The refresh ink ejection device according to claim 2, wherein the conductive member has a protrusion protruding toward the back electrode.

4. The refresh ink ejection device according to claim 2, wherein the conductive member includes an orifice plate formed with an orifice and a conductive plate provided on the orifice plate.

5. The refresh ink ejection device according to claim 1, wherein the conductive member is formed integrally with the ink collector.

6. The refresh ink ejection device according to claim 5, wherein the ink collector is an ink absorbing member.

7. The refresh ink ejection device according to claim 6, further comprising an ink receiving member connected to the ink collector for collecting ink residing on the ink collector.

8. The refresh ink ejection device according to claim 7 wherein the ink receiving member includes a vacuum pump for collecting ink by suctioning the ink.

9. The refresh ink ejection device according to claim 7, wherein the ink receiving member includes a large-capacity ink absorbing member for absorbing the ink residing on the ink collector by capillary action.

10. The refresh ink ejection device according to claim 5, wherein the ink collector os a narrow groove for leading ink.

11. The refresh ink ejection device according to claim 1, wherein said refresh ink droplet has one of reduced mass and reduced velocity compared to a recording ink droplet.

12. An inkjet recording device comprising an ink ejection means for generating and ejecting an ink droplet, a first control means for controlling the ink ejection means to eject a recording ink droplet, a second control means for controlling the ink ejection means to eject a refresh ink droplet, an ink collector for collecting the refresh ink droplet so that the refresh ink droplet impinges on the ink collector, wherein the deflecting means includes:

a conductive member having the same potential as ink that the ink ejection means holds, the conductive member being disposed in vicinity of where the ink droplet is generated;

a back electrode disposed behind a recording medium; and a voltage applying means for applying a voltage between the conductive member and the back electrode so as to generate a deflecting electric field; and the ink collector is disposed on a surface of the conductive member, the surface facing the recording medium;

the deflecting electric field deflects the recording ink droplet as needed, wherein the deflected recording ink droplet impinges on the recording medium; and the deflecting electric field deflects the refresh ink droplet so that the deflected refresh ink droplet impinges on the ink collector.

13. The inkjet recording device according to claim 12, wherein the first control means controls the ink ejection means to eject the recording ink droplet based on a recording signal during a recording operation, and the second deflecting means controls the ink ejection means to eject the refresh ink droplet during a time interval where no recording ink droplet is ejected during the recording operation, without stopping the recording operation.

14. The inkjet recording device according to claim 12, wherein the second control means controls the ink ejection means to eject the refresh ink droplet at a lower ejection speed than the recording ink droplet.

15. The inkjet recording device according to claim 12, wherein the refresh ink droplet has a smaller weight than the recording ink droplet.

16. The inkjet recording device according to claim 12, further comprising a charging means for charging the refresh ink droplet and the recording ink droplet, the charging means charges the refresh ink droplet to a larger potential than the recording ink droplet.

17. The inkjet recording device according to claim 12, wherein the deflecting electric field having a field element in a direction perpendicular to an ink ejection direction of the ink ejection means.

* * * * *